United States Patent [19]

Roncero

[11] Patent Number: 4,843,801

[45] Date of Patent: Jul. 4, 1989

[54] METHODS AND APPARATUS FOR OPENING CLOSED CONTAINERS

[75] Inventor: Jose I. Roncero, Richmond, Va.

[73] Assignee: Philip Morris Incorporated, New York, N.Y.

[21] Appl. No.: 198,497

[22] Filed: May 25, 1988

[51] Int. Cl.[4] ..... B65B 43/26

[52] U.S. Cl. ..... 53/492; 53/381 R; 414/411

[58] Field of Search ..... 53/381 R, 492; 414/411, 414/412, 414

[56] References Cited

U.S. PATENT DOCUMENTS

| | | | |
|---|---|---|---|
| 2,540,766 | 2/1951 | Stilwell et al. | 414/414 |
| 3,263,843 | 8/1966 | Grahn et al. | 414/412 |
| 3,386,320 | 6/1968 | Pinkham et al. | 414/412 |
| 3,889,442 | 6/1975 | Grahn et al. | 53/492 |
| 4,036,380 | 7/1977 | Berry et al. | 414/412 |
| 4,124,969 | 11/1978 | Peyton | 414/411 |

*Primary Examiner*—John Sipos
*Assistant Examiner*—Ann Tran
*Attorney, Agent, or Firm*—Robert R. Jackson

[57] ABSTRACT

Methods and apparatus for opening containers such as cigarette packages without damaging the contents of the containers. If desired, the methods and apparatus may be extended to include emptying the containers after they have been opened.

23 Claims, 10 Drawing Sheets

METHODS AND APPARATUS FOR OPENING CLOSED CONTAINERS

BACKGROUND OF THE INVENTION

This invention relates to methods and apparatus for opening closed containers, and more particularly to methods and apparatus for opening containers (such as cigarette packages) which contain relatively fragile contents. The invention also relates to methods and apparatus for emptying such containers once they have been opened.

Cigarette manufacturers frequently have a need to open large numbers of cigarette packages. For example, it may be necessary to open cigarette packages as part of a quality control process, or to make cigarettes available for smoking tests or other tests of the cigarettes. It may also be necessary to open packages found to be defective in order to recover the cigarettes for repackaging.

Heretofore, cigarette packages have been opened by hand. This is a tedious and time-consuming task which results in many damaged and unusable cigarettes.

In view of the foregoing, it is an object of this invention to provide methods and apparatus for automating the opening of closed containers such as cigarette packages.

It is a further object of this invention to provide methods and apparatus for automating the opening and emptying of closed containers such as cigarette packages.

SUMMARY OF THE INVENTION

These and other objects of the invention are accomplished in accordance with the principles of the invention by providing methods and apparatus for opening containers having parallel top and bottom walls, parallel front and back walls, and parallel left and right side walls in which the left and right side walls are cut through substantially continuously between the top and bottom walls, the front wall is cut through substantially continuously between the left and right side walls, and the container is opened by opening up the cut in the front wall. If the container is to be emptied, the foregoing container processing preferably takes place with the back wall facing down, and after the cut in the front wall has been opened up, the container is inverted so that the back wall faces up.

Further features of the invention, its nature and various advantages will be more apparent from the accompanying drawings and the following detailed description of the invention.

DETAILED DESCRIPTION OF THE PREFERRED EMBODIMENTS

Although this invention is applicable to opening many other types of containers, the invention will be fully understood from the following explanation of its application to opening conventional softsided cigarette packages.

Figure 2:
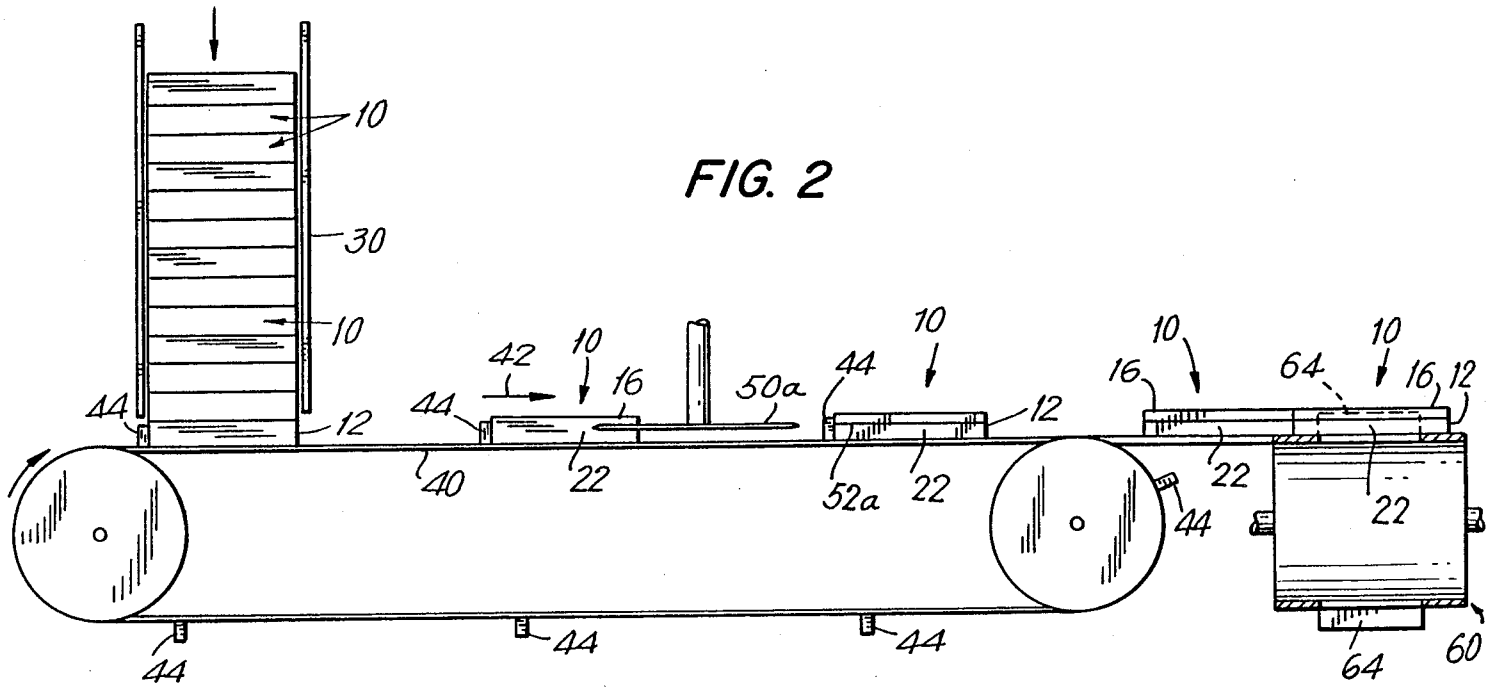
FIG. 2 is a view taken along the line 2—2 in FIG. 1.
Figure 2B:
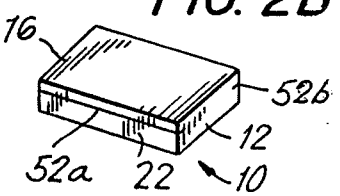
FIG. 2B is a perspective view of the package of FIG. 2A after an initial processing step.
Figure 2A:
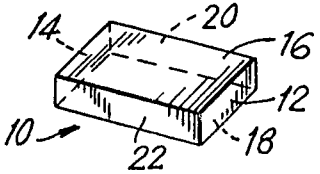
FIG. 2A is a perspective view of a package prior to processing.

As shown in FIG. 2A, a typical cigarette package 10 has parallel top and bottom walls 12 and 14, parallel front and back walls 16 and 18, and parallel left and right side walls 20 and 22. It is to be understood that terms like "top," "bottom," "front," "back," "left," and "right" are used herein and in the appended claims solely for convenience and clarity, and that these terms are applied to the container without regard to how the container may be oriented for any other purpose. For example, top wall 12 may in fact be the bottom wall of the container when considered from the standpoint of how the container is normally held in order to read the labelling printed on the container. However, that is irrelevant for present purposes, the naming of the various container walls being purely arbitrary herein.

As is best seen in FIG. 2, cigarette packages 10 to be opened are loaded, back wall down, into a hopper 30 located above one end of conveyor 40. Hopper 30 is oriented so that the top wall 12 of each package is perpendicular to the axis of motion 42 of the adjacent portion of conveyor 40. Conveyor 40 has a plurality of pusher bars 44 projecting out from the conveyor path and spaced along the length of the conveyor. The spacing between adjacent bars 44 is greater than the height of each package 10 (i.e., the distance between the top and bottom walls of each package). Accordingly, each time a bar 44 passes under hopper 30, it removes one package from the bottom of the hopper and conveys that package from left to right as viewed in FIG. 2.

After leaving hopper 30, each package 10 is conveyed by conveyor 40 between a pair of rotating circular saws **50*a* and 50*b*. Saw 50*a* cuts through right side wall 22 parallel to front wall 16 and continuously from top wall 12 to bottom wall 14 as shown at 52*a* in FIGS. 2 and 2B. Indeed, the cut 52*a* produced by saw 50*a* even extends a short way into top and bottom walls 12 and 14. Saw 50*b* forms a similar cut 52*b* in left side wall 20. Cuts 52 are preferably at a location where the saws 50 producing those cuts will not damage the contents of package 10. In the preferred embodiment, for example, package 10 contains 20 cigarettes 24 in three rows parallel to front wall 16. In particular, there are seven cigarettes in each of the front and back rows, and six cigarettes in the intermediate row. Accordingly, the left- and right-most cigarettes in the intermediate row are spaced in from left and right side walls 20 and 22, respectively. This makes the region adjacent the ends of the intermediate row a good location for forming cuts 52. For other reasons that will become apparent as the description proceeds, it is also generally desirable to form cuts 52 as close to front wall 16 as possible. Thus cuts 52 are preferably formed adjacent the ends of the intermediate row of cigarettes, but also closer to front wall 16 than to back wall 18**.

Figures 1, 1A:
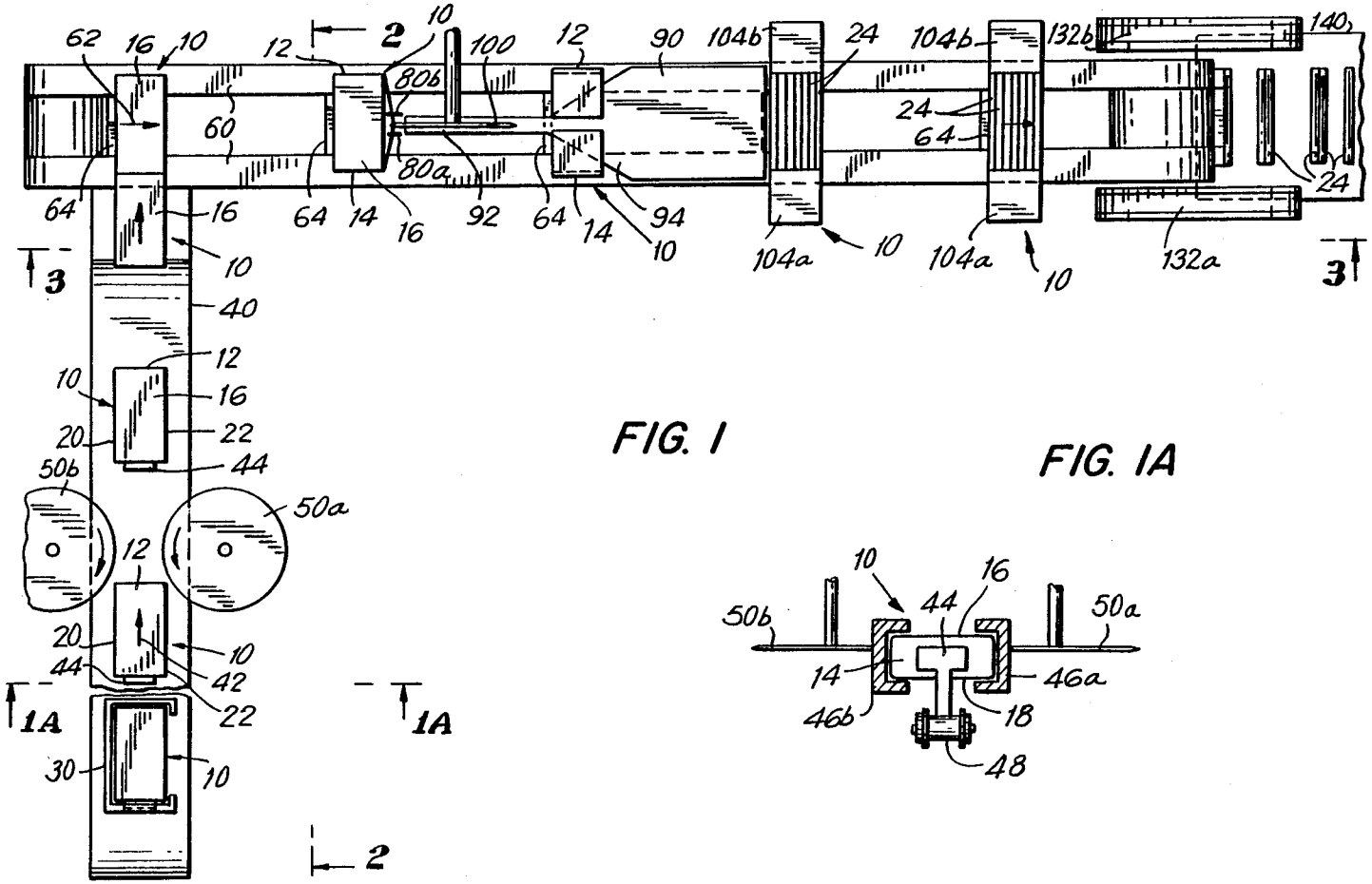
FIG. 1 is a simplified, partial, plan view of a portion of an illustrative embodiment of the container opening apparatus of this invention.
FIG. 1A is a more detailed view taken generally along the line 1A—1A in FIG. 1.

Although represented more simply in FIGS. 1 and 2, conveyor 40 may actually comprise a pair of opposing. stationary U-shaped channels 46*a* and 46*b* (FIG. 1A) through which packages 10 are pushed by pushers 44 mounted on chain drive 48. At the locations of saws 50, channels 46 are slotted to allow the saws to pass through and operate on package 10 as described above.

Figure 3:
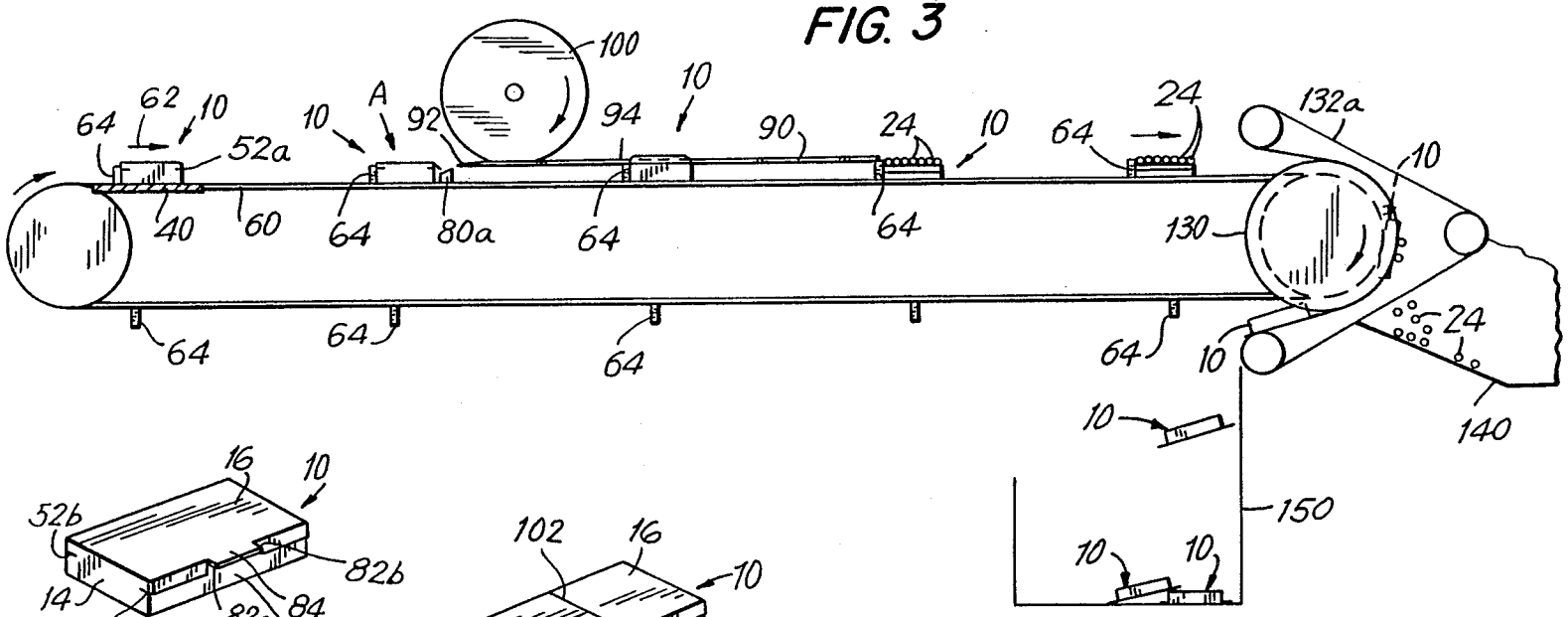
FIG. 3 is a view taken along the line 3—3 in FIG. 1.

At the end of conveyor 40, each package 10 is transferred to conveyor 60, which is oriented at a right angle to conveyor 40. Like conveyor 40, conveyor 60 has a plurality of pusher bars 64 extending out from the conveyor path for causing successive packages 10 to travel with conveyor 60 parallel to axis 62. The spacing between adjacent bars 64 is greater than the width of packages 10 (i.e., the distance between left and right side walls 20 and 22). The spacing between adjacent bars 64 and the speed of conveyor 60 are also such that packages 10 are conveyed away by conveyor 60 at the same rate that they leave conveyor 40. Again, although represented more simply in FIGS. 1–3, conveyor 60 may actually (1) support packages 10 by means of stationary plate 68*a* (FIGS. 4, 5, 7, and 8), (2) guide packages 10 between stationary side rails 68*b* and 68*c* (FIG. 8), (3) hold down packages 10 by means of stationary hold-down plates 68*d* and 68*e* (FIG. 8), and (4) drive pusher bars 64 by mounting them on a pair of chain drives 68*f* and 68*g* (FIGS. 5–7 and 10).

Figure 8:
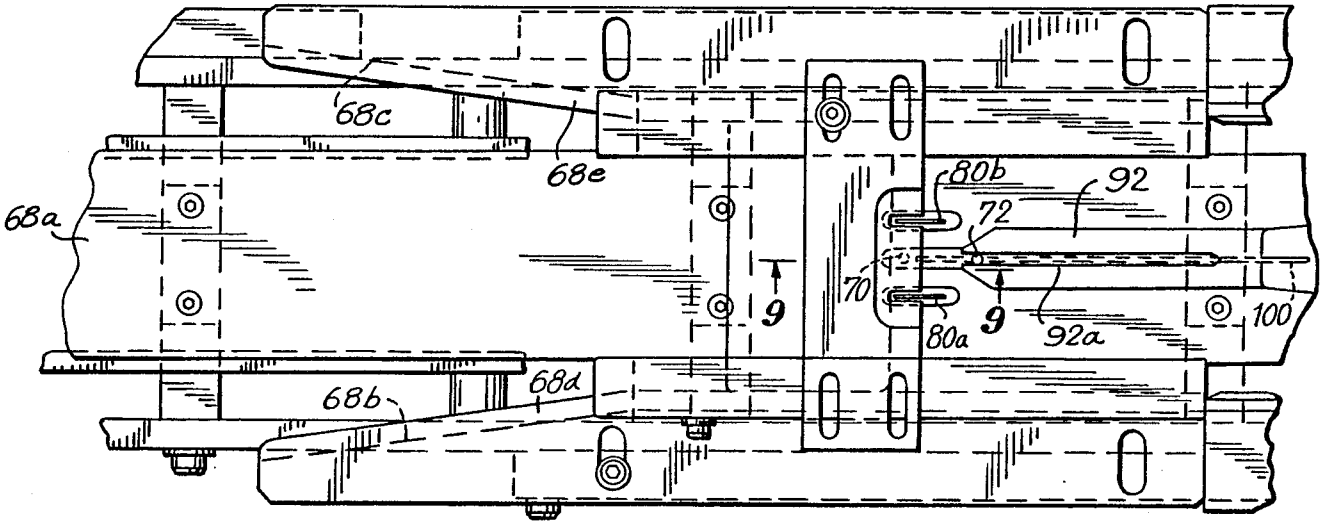
FIG. 8 is a more detailed plan view of another portion of the apparatus of FIGS. 1–3 (i.e., an intermediate portion of the second conveyor).
Figure 9:
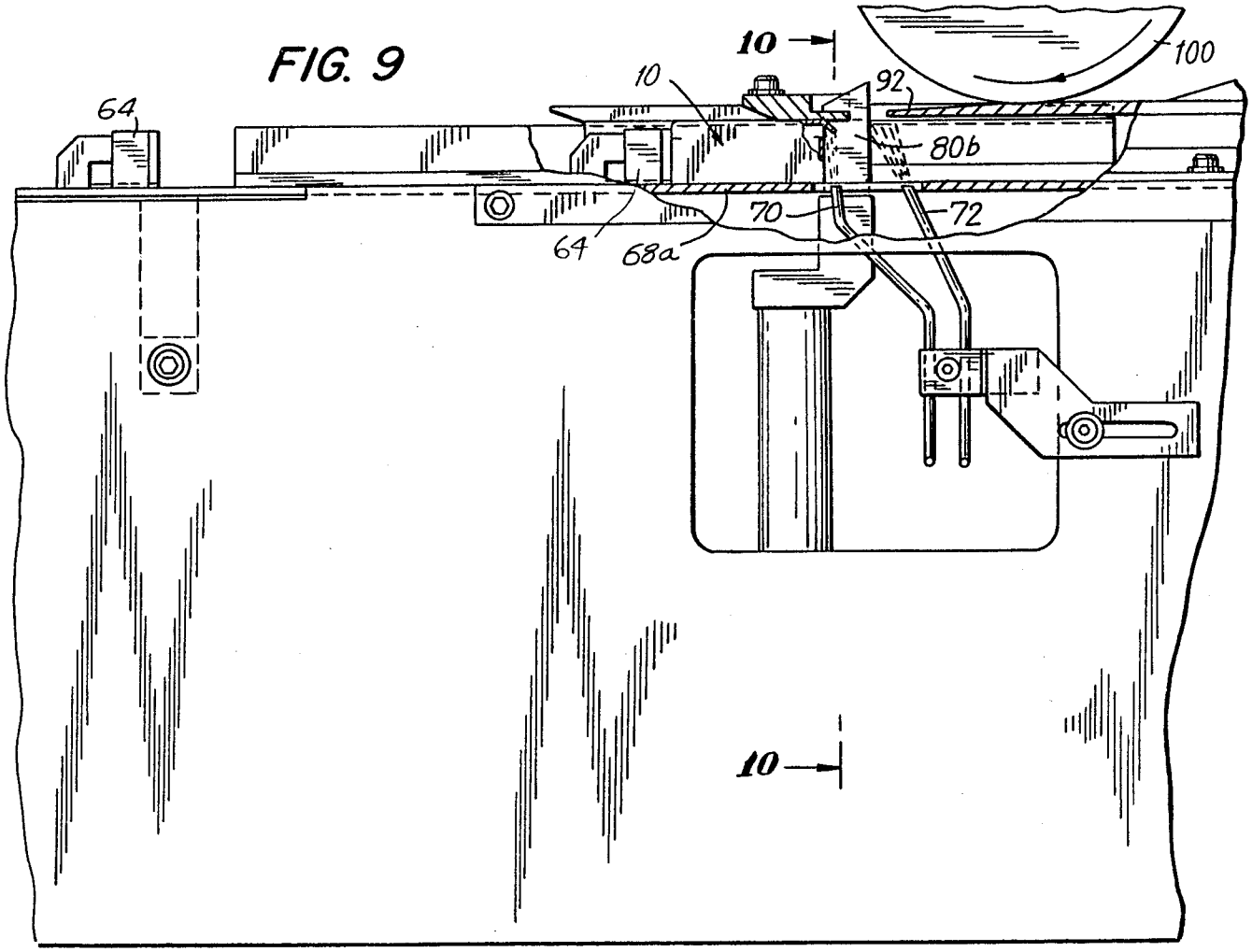
FIG. 9 is an elevational view, partly in section, of the apparatus of FIG. 8.
Figure 10:
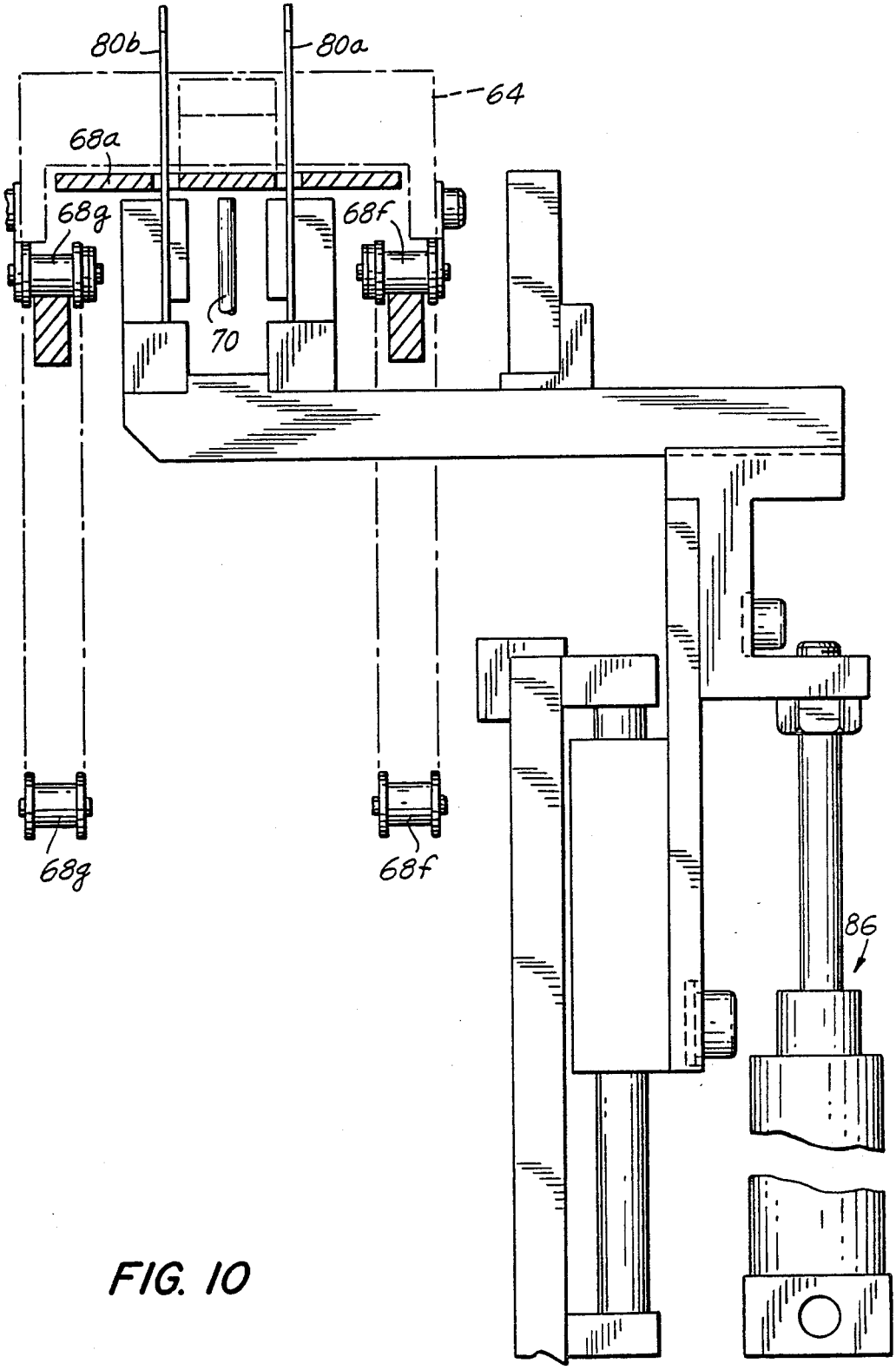
FIG. 10 is a view taken along the line 10—10 in FIG. 9.

When each package 10 reaches location A (FIG. 3) on conveyor 60, a blast of air is applied by nozzle 70 (FIGS. 8–10) to cause the portion of right side wall 22 above cut 52*a* to bulge out. While this portion of package 10 is thus bulged out, knives 80*a* and 80*b* (FIGS. 1, 3, and 8–10) are recipocated up through the path of conveyor 60 to form two, small, laterally spaced cuts 82*a* and 82*b* (FIG. 3A) through the bulged-out portion of right side wall 22. In particular, each of cuts 82 extends (parallel to top and bottom walls 12 and 14) from front wall 16 to cut 52*a*. The portion of front wall 22 between cuts 82 forms a tab 84 which is held up substantially parallel to front wall 16 by the air blast mentioned above. Conveyors 40 and 60 preferably both stop momentarily during operation of knives 80. The motion of knives 80 is produced by conventional pneumatic or mechanical actuator apparatus 86 (FIG. 10).

As soon as cuts 82 have been formed, knives 80 reciprocate back down through the path of conveyor 60, and conveyors 40 and 60 start moving again. An air blast from nozzle 72 (FIGS. 8 and 9) keeps tab 84 up so that as conveyor 60 continues to move the container along, the relatively narrow and thin initial portion 92 of stationary member 90 passes under flap 84 and enters package 10 immediately below front wall 16. In order for member 90 not to disturb the contents of package 10, initial portion 92 preferably cooperates with flap 84 to raise front wall 16 slightly as initial portion 92 enters the package.

Figure 3B:
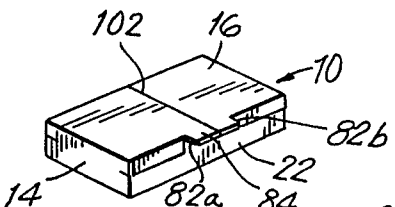
Figure 4:
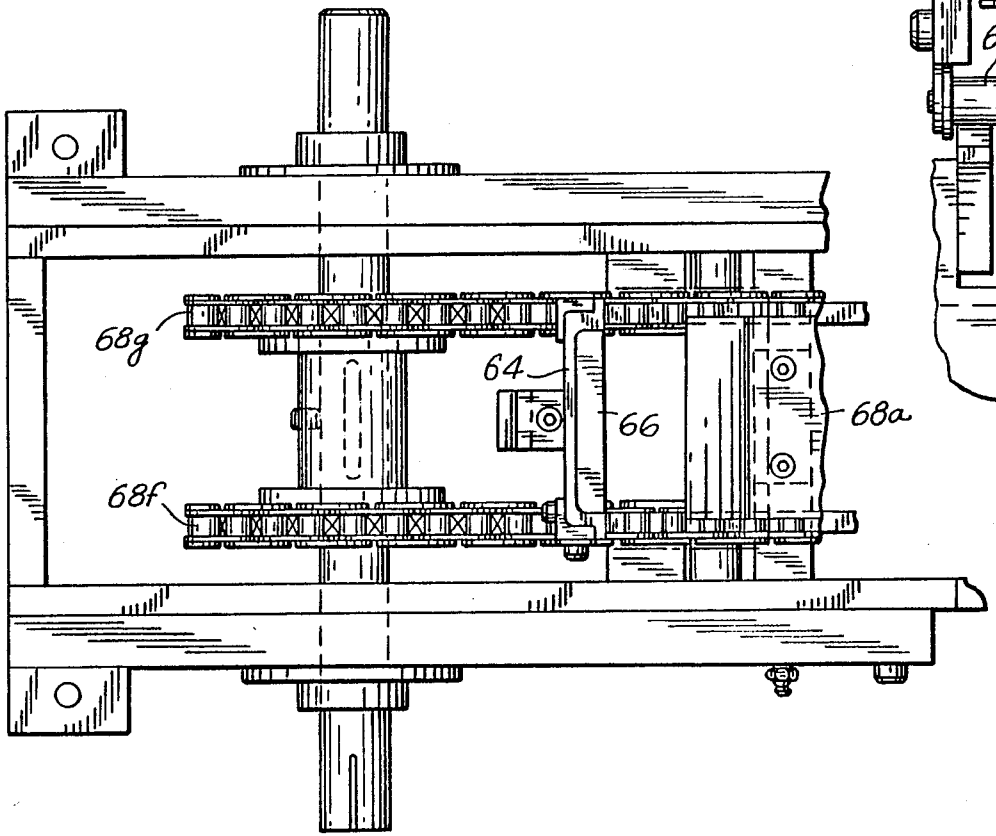
FIG. 4 is a more detailed plan view of a portion of the apparatus of FIGS. 1–3 (i.e., the initial portion of the second conveyor).
Figure 7:
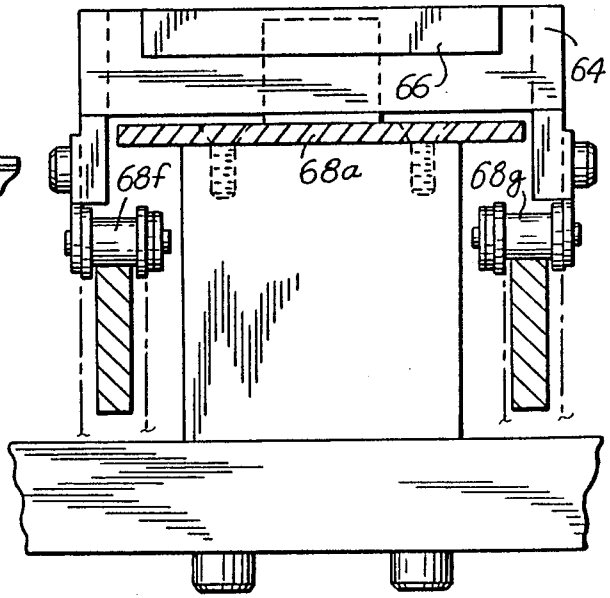
FIG. 7 is a view taken along the line 7—7 in FIG. 5.
Figure 5:
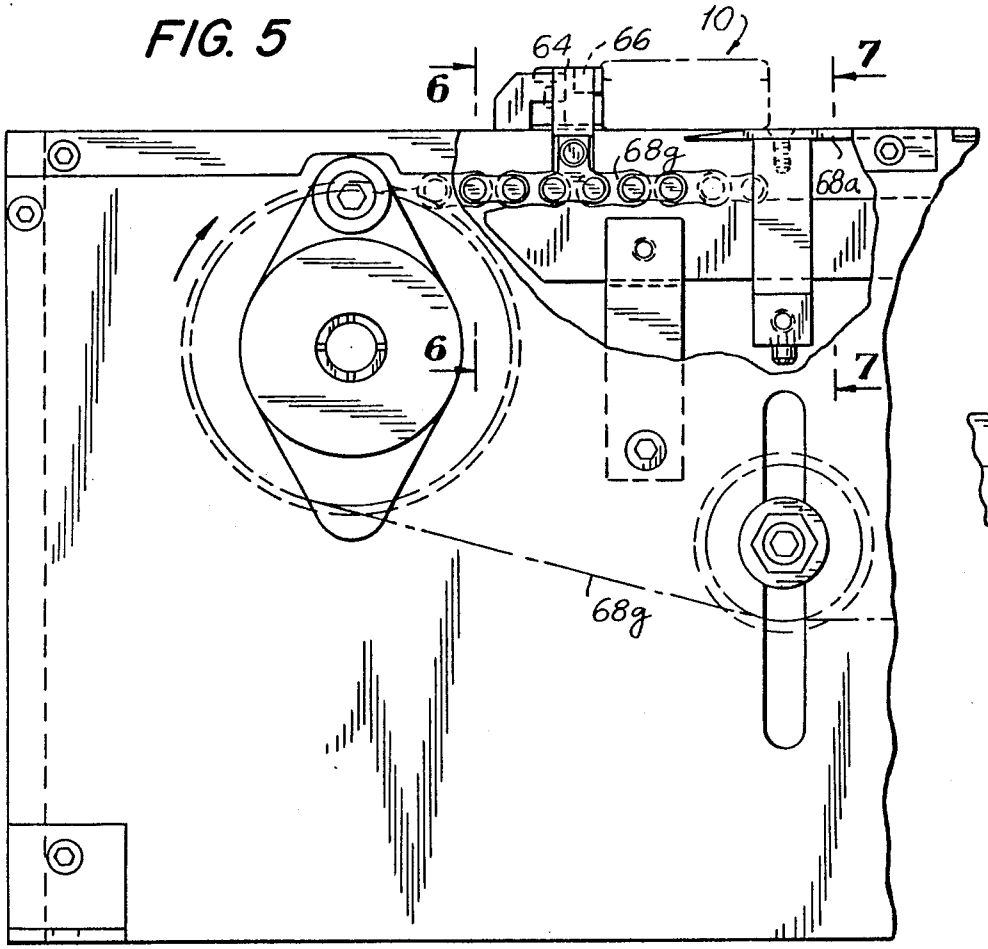
FIG. 5 is an elevational view, partly in section, of the apparatus of FIG. 4.

Shortly after initial portion 92 enters package 10, front wall 16 is cut through by rotating circular saw 100. (Saw 100 can be rotated in either direction, and indeed it may be preferable to rotate it in the direction opposite the direction indicated in the drawings in order to help pull package 10 onto initial portion 92.) Saw 100 cuts through front wall 16 between left and right side walls 20 and 22. The resulting cut 102 (FIG. 3B) is parallel to top and bottom walls 12 and 14, and in the preferred embodiment is midway between those walls. In addition, because flap 84 is parallel to front wall 16, it is also cut through. And because initial portion 92 forces the portion of left side wall 20 above cut 52*b* to pivot out and up parallel to front wall 16, that portion of left side wall 20 is also cut through. As is best seen in FIGS. 4, 5, and 7, the upper portion of the front of each pusher 64 is relieved or recessed at 66 to allow initial portion 92 to pivot the upper portion of left side wall 20 out as described above. To ensure that saw 100 does not damage the contents of package 10, saw 100 is preferably disposed above initial portion 92 and cooperates with a slot 92*a* in initial portion 92 to form cut 102.

Figure 3C:
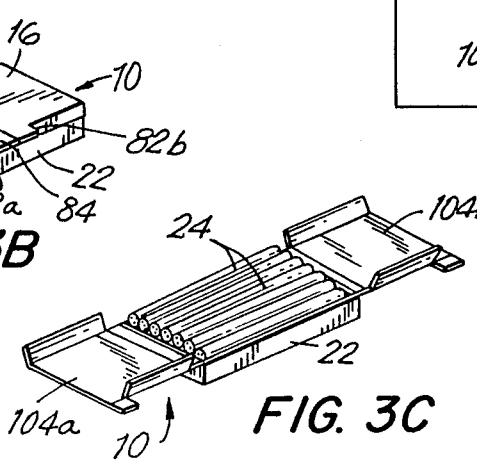
FIGS. 3A–3C are perspective views of the package of FIGS. 2A and 2B after successive further processing steps.
Figure 3A:
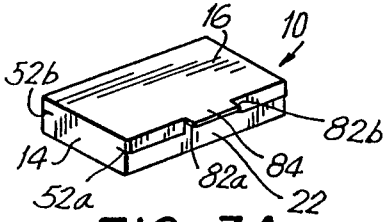
Figure 6:
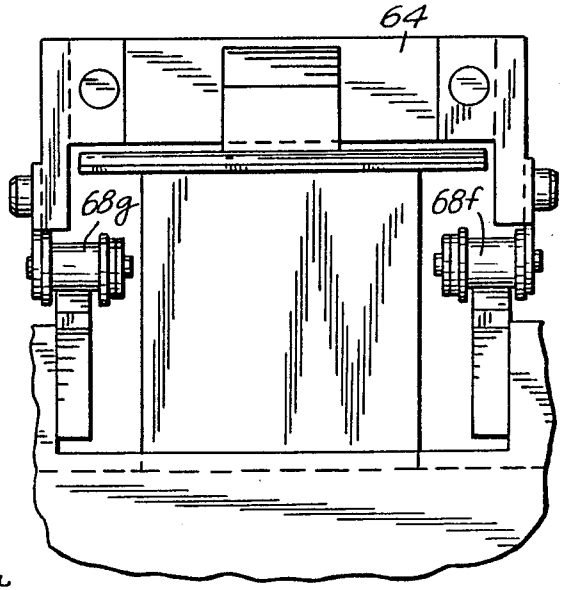
FIG. 6 is a view taken along the line 6—6 in FIG. 5.
Figure 11:
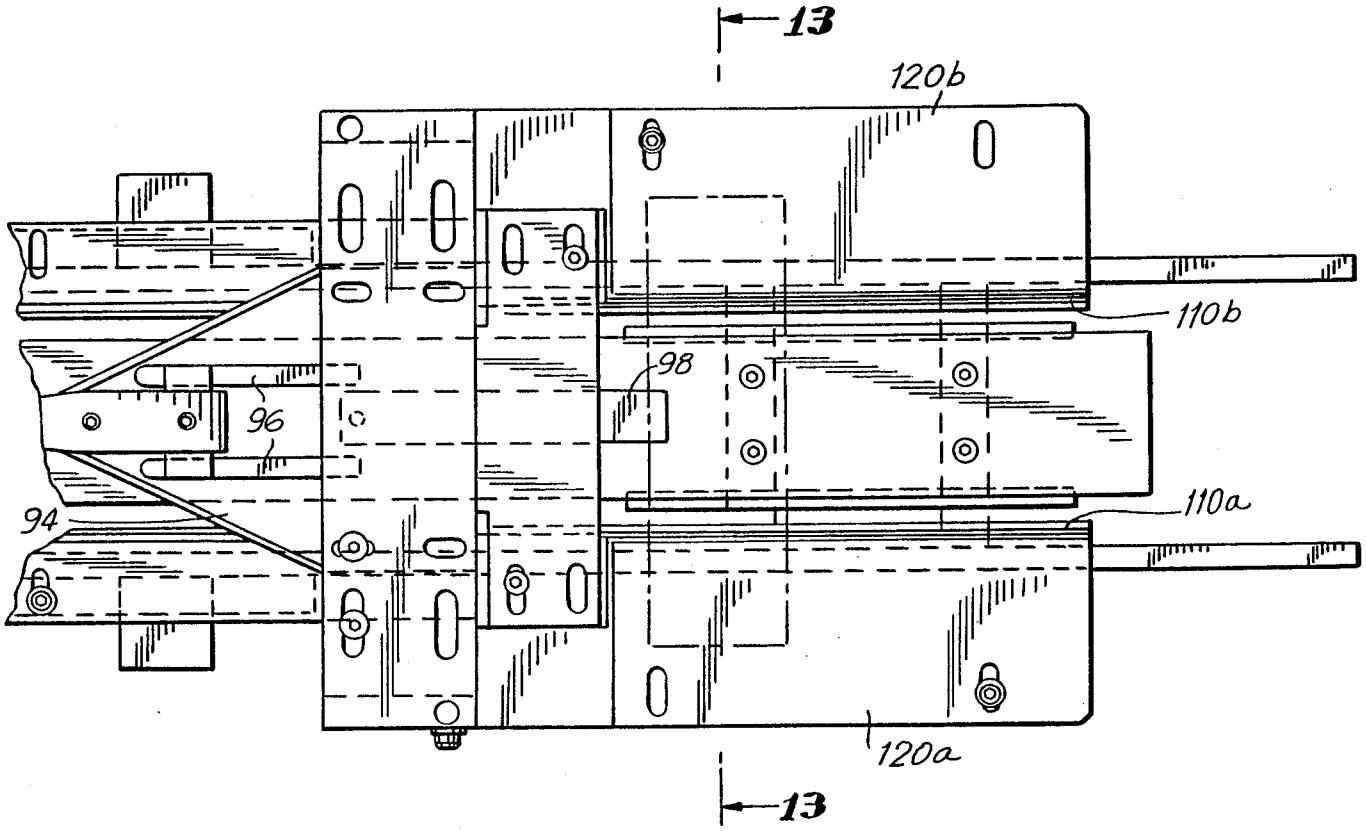
FIG. 11 is a more detailed plan view of yet another portion of the apparatus of FIGS. 1–3 (i.e., a later intermediate portion of the second conveyor).
Figure 12:
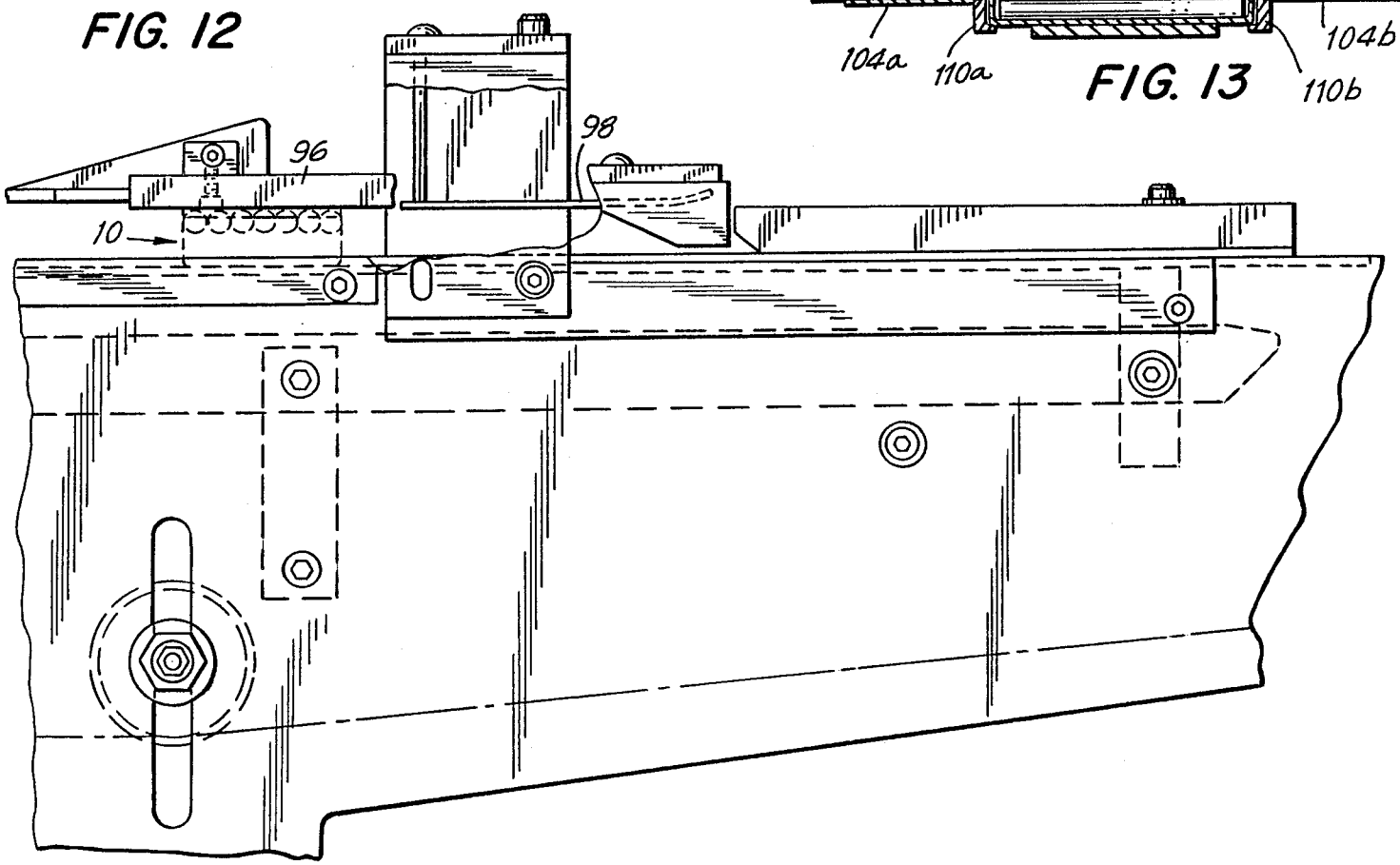
FIG. 12 is an elevational view, partly in section, of the apparatus of FIG. 11.

After passing saw 100, package 10 is forced by conveyor 60 onto the intermediate portion 94 of member 90. Whereas initial portion 90 is relatively narrow as viewed in FIG. 1 (i.e., preferably narrower than flap 84 measured between cuts 82), intermediate portion 94 tapers out in width in the direction of motion of the packages on conveyor 60 until it is wider than the distance between top and bottom walls 12 and 14. Accordingly, intermediate portion 94 forces cut 102 to open up by pivoting the two portions of front wall 16 (and the connected portions of left and right side walls 20 and 22) up, out, and away from the remainder of the package as shown in FIG. 3C. This completely opens package 10 and leaves two large flaps 104*a* and 104*b* extending out from the respective opposite ends of the package. To help make sure that the cigarettes 24 remain in package 10 as it is being opened, floating weights 96 (FIGS. 11 and 12) press down lightly on the cigarettes as the package passes under this portion of member 90. This hold-down action is continued by spring finger 98.

Figure 13:
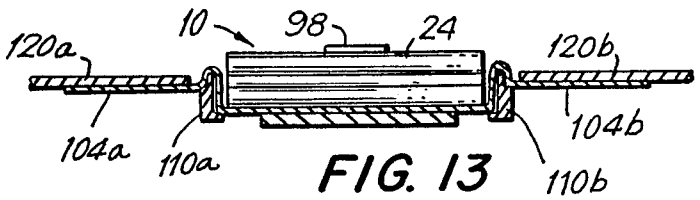
FIG. 13 is a view taken along the line 13—13 in FIG. 11.

Flaps 104 are formed in part by folding the bases of those flaps over rails 110 (FIGS. 11 and 13) which extend generally parallel to top and bottom walls 12 and 14. Flaps 104 are forced down over these rails by hold-down plates 120. Although generally parallel to top and bottom walls 12 and 14, rails 110 preferably diverge slightly from one another in the machine direction in order to pull top and bottom walls 12 and 14 slightly away from the ends of cigarettes 24. This helps ensure that all of cigarettes 24 spill out of package 10 when the package is subsequently inverted.

After top and bottom walls 12 and 14 have been pulled apart as described above, each of flaps 104 is engaged between a wheel 130 and a pressure belt 132. Wheels 130 are concentric with the adjacent end of conveyor 60, and rotate at the same angular velocity as that end of the conveyor. Accordingly, elements 130 and 132 cause package 10 to move around the end of conveyor 60, thereby inverting the package and allowing cigarettes 24 to spill out into hopper 140. Pressure belts 132 then convey the empty packages to hopper 150.

I claim:

1. The method of opening a closed container having parallel top and bottom walls, parallel front and back walls, and parallel left and right side walls comprising the steps of:

cutting said left and right side walls substantially continuously between said top and bottom walls;

cutting said front wall substantially continuously between said left and right side walls;

inserting a member into the container adjacent the front wall via the cut in one of said left and right side walls; and using the member to open up the cut in said front wall in order to open the container, wherein the member is inserted into the container prior to cutting said front wall, and wherein said member supports said front wall during the cutting thereof.

2. The method of opening a closed container having parallel top and bottom walls, parallel front and back walls, and parallel left and right side walls comprising the steps of:

cutting said left and right side walls substantially continuously between said top and bottom walls;

cutting said front wall substantially continuously between said left and right side walls;

inserting a member into the container adjacent the front wall via the cut in one of said left and right side walls; and using the member to open up the cut in said front wall in order to open the container, wherein said one of said left and right side walls is cut at a location spaced from said front and back walls, and wherein said method further comprises the step of:

opening up the cut in said one of said left and right side walls prior to inserting said member or cutting said front wall by pivoting the midportion of said one of said left and right side walls out from said container toward parallelism with said front wall.

3. The method defined in claim 2 further comprising the step of:

cutting said midportion substantially continuously between the front wall and the cut in said one of said left and right side walls during said pivoting of said midportion.

4. The method defined in claim 3 wherein said cutting of said midportion produces two flapproducing cuts in said midportion, said flap-producing cuts being on respective opposite sides of the location at which said member is to be inserted.

5. The method defined in claim 4 further comprising the step of:

pivoting the portion of said midportion between said flap-producing cuts out from said container into substantial parallelism with said front wall prior to inserting said member or cutting said front wall.

6. The method defined in claim 5 further comprising the step of:

continuing the cut in said front wall across said portion of said midportion after said portion of said midportion is substantially parallel to said front wall.

7. The method define in claim 1 wherein said container contains a plurality of cigarettes whose longitudinal axes are all parallel to said front, back, left and right side walls, said cigarettes being packed in three rows of N cigarettes in a front row adjacent said front wall, N cigarettes in a back row adjacent said back wall, and N-1 cigarettes in a row intermediate said front and back rows, so that the cigarettes at each end of the intermediate row are spaced in from the adjacent portions of said left and right side walls, and wherein said left and right side walls are cut adjacent the ends of said intermediate row.

8. The method define in claim 1 wherein said front wall is cut substantially parallel to said top and bottom walls.

9. The method defined in claim 8 wherein said front wall is cut midway between said top and bottom walls.

10. The method defined in claim 1 further comprising the step of:

pulling the top and bottom walls away from one another after opening up the cut in said front wall.

11. The method defined in claim 1 wherein said container initially encloses an object which it is desired to remove from the container after it has been opened, wherein said step of using the member to open up the cut in said front wall is performed with said back wall facing down, and wherein said method further comprises the step of:

turning the container over so that the back wall faces up and so that the object falls out of the container through the opened cut in said front wall.

12. Apparatus for opening a closed container having parallel top and bottom walls, parallel front and back walls, and parallel left and right side walls comprising:

means for cutting said left and right side walls substantially continuously between said top and bottom walls;

means for cutting said front wall substantially continuously between said left and right side walls;

means for opening up the cut in said front wall by pivoting the portion of said front wall on at least one side of the cut in said front wall out away from the remainder of the container; and means for cutting at least one of said left and right side walls substantially continuously between the front wall and the cut in said one of said left and right side walls at two locations spaced on opposite sides of the cut in said front wall prior to cutting said front wall.

13. The apparatus defined in claim 12 further comprising:

means for pivoting the portion of said one of said left and right side walls which is between the cuts at said two locations out from said container and substantially parallel to said front wall.

14. The apparatus defined in claim 13 further comprising:

means for extending the cut in said front wall substantially continuously across said portion of said one of said left and right side walls after said portion had been pivoted substantially parallel to said first wall.

15. Apparatus for opening a closed containing having parallel top and bottom walls, parallel front and back walls, and parallel left and right side walls comprising:

means for cutting said left and right side walls substantially continuously between said top and bottom walls;

means for inserting a member into said container adjacent said front wall via the cut in one of said left and right side walls;

means for cutting said front wall against said member substantially continuously between said left and right side walls; and means for opening up the cut in said front wall by using said member to pivot the portion of said front wall on at least one side of the cut in said front wall out away from the remainder of the container.

16. The apparatus defined in claim 12 further comprising:

means for pivoting the portion of said at least one of said left and right side walls between said front wall and said cut in said side wall out from the container prior to cutting said said wall at said two locations.

17. The apparatus defined in claim 12 wherein said container contains a plurality of cigarettes whose longitudinal axes are all parallel to said front, back, left, and right side walls, said cigarettes being packed in three rows of N cigarettes in a front row adjacent said front wall, N cigarettes in a back row adjacent said back wall, and N-1 cigarettes in a row intermediate said front and back rows, so that the cigarettes at each end of the intermediate row are spaced in from the adjacent portions of said left and right side walls, and wherein said means for cutting said left and right side walls cut said left and right side walls adjacent the ends of said intermediate row.

18. The apparatus defined in claim 12 wherein said means for cutting said front wall cuts said front wall substantially parallel to said top and bottom walls.

19. The apparatus defined in claim 18 wherein said means for cutting said front wall cuts said front wall midway between said top and bottom walls.

20. The apparatus defined in claim 12 further comprising:

means for pulling the top and bottom walls away from one another after opening up the cut in said front wall.

21. The apparatus defined in claim 12 wherein said container initially encloses an object which it is desired to remove from the container after it has been opened, wherein said back wall faces down during operation of said means for opening up the cut in said front wall, and wherein said apparatus further comprises:

means for turning the container over so that the back wall faces up and so that the object falls out of the container through the opened cut in said front wall.

22. The apparatus defined in claim 12 further comprising:

means for extending the cut in said front wall substantially continuously between said front wall and the cut in at least one of said left and right wide walls prior to opening up the cut in said front wall.

23. The apparatus defined in claim 15 wherein said member has an initial portion which is narrower than the distance between said top and bottom walls to facilitate entry of the initial portion into the container, and a subsequent portion which tapers out to a width greater than the distance between said top and bottom walls so that as said subsequent portion enters the container, it forces the cut in said front wall to open up.

* * * * *

UNITED STATES PATENT AND TRADEMARK OFFICE

CERTIFICATE OF CORRECTION

PATENT NO. : 4,843,801

DATED : July 4, 1989

INVENTOR(S) : Jose I. Roncero

It is certified that error appears in the above-identified patent and that said Letters Patent is hereby corrected as shown below:

| Column | Line | |
|---|---|---|
| 5 | 45 | Change "flapproducing" to --flap-producing--. |
| 5 | 61 | Change "define" to --defined--. |
| 6 | 5 | Change "define" to --defined--. |
| 6 | 53 | Change "had" to --has--. |
| 6 | 55 | Change "containing" to --container--. |
| 7 | 8 | Change "said" (second occurrence) to --side--. |

Signed and Sealed this

Ninth Day of July, 1991

*Attest:*

*Attesting Officer*

HARRY F. MANBECK, JR.

*Commissioner of Patents and Trademarks*